US006047529A

United States Patent [19]

Draghetti

[11] Patent Number: 6,047,529

[45] Date of Patent: Apr. 11, 2000

[54] FOLDING METHOD FOR FORMING A SEALED TUBULAR WRAPPING

[75] Inventor: Fiorenzo Draghetti, Medicina, Italy

[73] Assignee: G. D Societa Per Azioni, Bologna, Italy

[21] Appl. No.: 09/039,827

[22] Filed: Mar. 16, 1998

[30] Foreign Application Priority Data

Mar. 17, 1997 [IT] Italy ..... BO97A0150

[51] Int. Cl.[7] ..... B65B 11/00

[52] U.S. Cl. ..... 53/466; 53/377.4; 53/234; 53/491

[58] Field of Search ..... 53/466, 461, 463, 53/476, 491, 228, 232, 234, 586, 373.3, 376.5, 377.4; 493/192, 264, 276, 277; 156/69; 11/152

[56] References Cited

U.S. PATENT DOCUMENTS

| | | | |
|---|---|---|---|
| 4,198,258 | 4/1980 | Glosmann | 156/484 |
| 4,285,679 | 8/1981 | Wahle | 493/125 |
| 4,617,780 | 10/1986 | Focke et al. | 53/466 |
| 4,838,846 | 6/1989 | Focke et al. | 493/132 |
| 4,887,408 | 12/1989 | Mattei et al. | 53/412 |
| 5,003,755 | 4/1991 | Draghetti | 53/466 |
| 5,156,279 | 10/1992 | Draghetti | 209/654 |
| 5,406,775 | 4/1995 | Tacchi et al. | 53/466 |
| 5,410,862 | 5/1995 | Janhonen | 53/590 |
| 5,613,932 | 3/1997 | Focke et al. | 493/128 |
| 5,680,745 | 10/1997 | Brizzi et al. | 53/448 |
| 5,732,533 | 3/1998 | Focke et al. | 53/466 |
| 5,755,080 | 5/1998 | Draghetti et al. | 53/466 |
| 5,822,954 | 10/1998 | Osti et al. | 53/466 |
| 5,906,087 | 5/1999 | Boldring | 53/462 |
| 5,946,890 | 9/1999 | Focke et al. | 53/466 |

FOREIGN PATENT DOCUMENTS 435340 10/1926 Germany .

*Primary Examiner*—Ed Tolan
*Attorney, Agent, or Firm*—Ladas & Parry

[57] ABSTRACT

A folding method for forming a sealed tubular wrapping about a packet, whereby the packet is fed onto a step-operated folding conveyor together with a sheet of wrapping material having a first and a second end portion; the sheet is folded into a tube about the packet so that the first end portion is superimposed on the second end portion along one of the surfaces of the packet; and the first end portion is then detached from the second end portion to deposit adhesive between the first and second end portions, and is then brought back into contact with the second end portion.

10 Claims, 2 Drawing Sheets

FOLDING METHOD FOR FORMING A SEALED TUBULAR WRAPPING

BACKGROUND OF THE INVENTION

The present invention relates to a folding method for forming a sealed tubular wrapping.

In particular, the invention relates to a folding method for forming a sealed tubular wrapping about a packet of cigarettes or a group of packets of cigarettes, to which the following description refers purely by way of example. In the following description, the product for wrapping is referred to, purely for the sake of simplicity, as the "packet", with no limitation intended.

In the tobacco industry, a sheet of wrapping material is normally folded into a tube about a packet of cigarettes, or a parallelepiped group of packets of cigarettes, having four lateral surfaces. The sheet of wrapping material is folded by means of a folding device comprising a pocket conveyor, which is fed in steps along a given path along which folding means are provided. The packet is normally fed, together with the sheet of wrapping material, into a respective pocket on the conveyor to form a first U-shaped fold, and two end portions of the sheet are then folded one on top of the other to form a tubular wrapping.

In the above known method, the sheet of wrapping material is fed to the folding device with one of the end portions already coated with adhesive, so as to seal the wrapping when the two end portions are superimposed.

Though a fast way of forming sealed tubular wrappings, the above method fails to prevent the adhesive on one of the end portions of the sheet of wrapping material from fouling the components of the folding device or the packets themselves, and so impairing operation of the device and the appearance of the packet.

One proposed solution to the problem is to supply the sheet of wrapping material without the adhesive, and to apply the adhesive just before the last end portion is folded.

For example DE-C-435340 discloses a wrapping device, wherein the sheet of wrapping material is supplied without the adhesive and the adhesive is applied just before the last end portion is folded. According to DE-C-435340, a product, in particular tobacco powder, is fed in a U-shaped wrapping sheet arranged in a folding pocket with two end portions of the wrapping sheet extending outside the pocket; then a first of the end portions is partially folded over the product. To allow completing the folding of the first end portion, that is to allow further folding an end part of the first end portion over 90° about the product, a portion of the wrapping sheet adjacent to a second of the end portions is slightly detached from the product. During the above detachment operation, the second end portion, which is still in its unfolded configuration, is gummed just before its folding over the first end portion.

Even this method, however, is not altogether satisfactory by prolonging stoppage of the conveyor to apply the adhesive at the station where the last end portion is folded, and on account of the difficulty, for reasons of space, in installing gumming devices immediately upstream from the station where the last end portion is folded.

Moreover, the above known method involves the additional drawback of requiring the use of a relatively complicated deformable pocket.

SUMMARY OF THE INVENTION

It is an object of the present invention to provide a method designed to overcome the aforementioned drawbacks.

According to the present invention, there is provided a folding method for forming a sealed tubular wrapping about a packet, the method comprising the steps of feeding the packet, together with a sheet of wrapping material, into a pocket of a folding step conveyor so as to fold the wrapping sheet in a U about the packet with two end portions of the wrapping sheet extending outside the pocket; and folding said sheet into a tube about said packet by superimposing the first end portion on the second end portion; said method being characterized by comprising the further steps of detaching the first end portion from the second end portion; depositing an adhesive substance between the first and second end portion; and bringing the first end portion back into contact with the second end portion.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
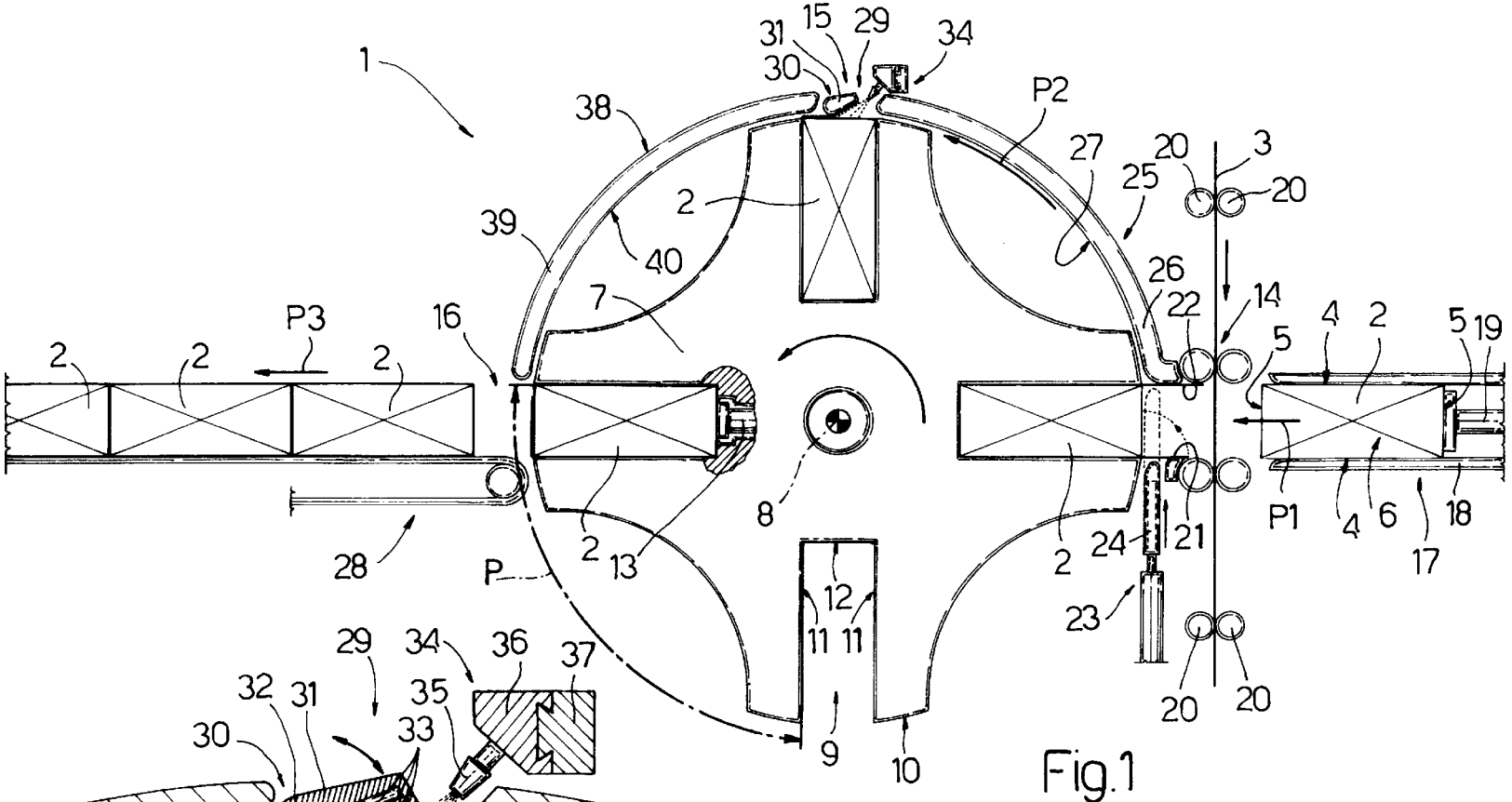
FIG. 1 shows a schematic front view, with parts removed for clarity, of a folding device implementing the method according to the present invention.
Figure 2:
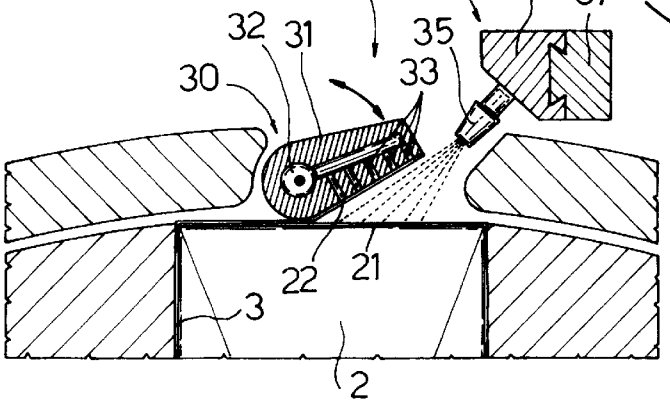
FIG. 2 shows a larger-scale section of a detail in FIG. 1.

Numberal 1 in FIG. 1 indicates as a whole a folding device for forming a sealed tubular wrapping about a packet 2 with a sheet 3 of wrapping material. Packet 2 is in the form of a parallelepipedon, and is defined by two large lateral surfaces 4, two small lateral surfaces 5, and two end surfaces 6, only one of which is shown in FIG. 1.

Device 1 comprises a wheel 7, which rotates counterclockwise (in FIG. 1) about a respective axis 8 of rotation, and in turn comprises a succession of pockets 9 equally spaced with an angular spacing P along a peripheral surface 10 of wheel 7.

Each pocket 9 houses a packet 2, and has two facing parallel surfaces 11 perpendicular to and on either side of a bottom surface 12 through which known expelling means 13 are movable radially.

Device 1 also comprises a folding station 14, a gumming station 15, and an unloading station 16, which are located successively along a path P2 and separated from one another by a distance equal to spacing P.

Station 14 houses a known feed assembly 17 for supplying packets 2 and comprising, for example, a guide channel 18, and a pusher 19 operating inside channel 18. Assembly 17 is located facing surface 10 of wheel 7 to feed packets 2 along a straight path P1 extending through axis 8 of wheel 7. A known feed assembly 20 for supplying sheets 3 to station 14 is located between wheel 7 and assembly 17, and provides for feeding sheets 3 in a direction substantially perpendicular to path P1, and for positioning and retaining, for each packet 2, a sheet 3 perpendicular to path P1.

When a pocket 9 is arrested at station 14, assembly 17 feeds packet 2 along path P1 until packet 2 is fully inserted inside respective pocket 9. As it is fed along path P1, packet 2 draws along sheet 3, which is inserted inside pocket 9 and folded into a U about a surface 5 and surfaces 4.

In this position, sheet 3 has two portions 21 and 22 projecting outwards from pocket 9 on either side of packet 2.

At folding station 14, a movable folding device 23 is located upstream, in the rotation direction of wheel 7, from the pocket 9 arrested at station 14, and comprises a movable plate 24, which moves back and forth between a rest position shown by the continuous line in FIG. 1, and a work position shown by the dotted line in FIG. 1 and in which plate 24 contacts the free small lateral surface 5 of packet 2 inside pocket 9 to fold portion 21 onto surface 5.

A fixed folding device 25 extends between station 14 and the follow-up gumming station 15, and is defined by a curved plate 26 having a surface 27 facing and mating with surface 10 of wheel 7 with a relatively small amount of radial clearance, so that, as pocket 9 travels along path P2, portion 22 is folded onto the free surface 5 to overlap portion 21.

Unloading station 16 comprises a conveyor 28 for supporting the packets 2 expelled from pockets 9 by expelling means 13, and for feeding packets 2 along a given path P3.

Gumming station 15 is located between folding station 14 and unloading station 16 along path P2, and is defined by a gumming unit 29 having a gripping member 30 movable back and forth between two operating positions. Gripping member 30 comprises a plate 31 mounted for rotation about an axis 32 parallel to axis 8 (FIG. 3), in turn comprising a number of suction holes 33, and which provides for engaging and detaching a portion of portion 22 from portion 21.

Unit 29 also comprises a gumming member 34 having an ejector 35 fitted to a central body 36 in turn fitted in sliding manner to a guide 37 parallel to axis 8.

Device 1 also comprises a stabilizing member 38 located between gumming station 15 and unloading station 16, and which comprises a curved plate 39 having a surface 40 facing and mating with surface 10 of wheel 7 with a relatively small amount of radial clearance. Plate 39 provides for holding portion 22 contacting and in position on portion 21 as respective packet 2 is transferred between gumming station 15 and unloading station 16.

In actual use, when pocket 9 is arrested at folding station 14, and after sheet 3 is folded into a U about surfaces 4 and one of surfaces 5 inside pocket 9, plate 24 of movable folding device 23 is moved into the work position to fold portion 21 onto the free small lateral surface 5.

As wheel 7 is rotated one step P, packet 2 is fed past surface 27 of fixed folding device 25 to fold portion 22 onto portion 21.

At gumming station 15, sheet 3 therefore arrives folded into a tube about packet 2; portion 22 is engaged partially by plate 31 and detached by plate 31 from portion 21; ejector 35 of gumming member 34, which slides along guide 37 crosswise to path P2, deposits a strip or a series of spots of adhesive along portion 21; and the raised portion of portion 22 is then replaced on portion 21 by plate 31.

Portion 22 is stabilized in the folded position by plate 39 as packet 2 is fed towards unloading station 16.

Figure 3:
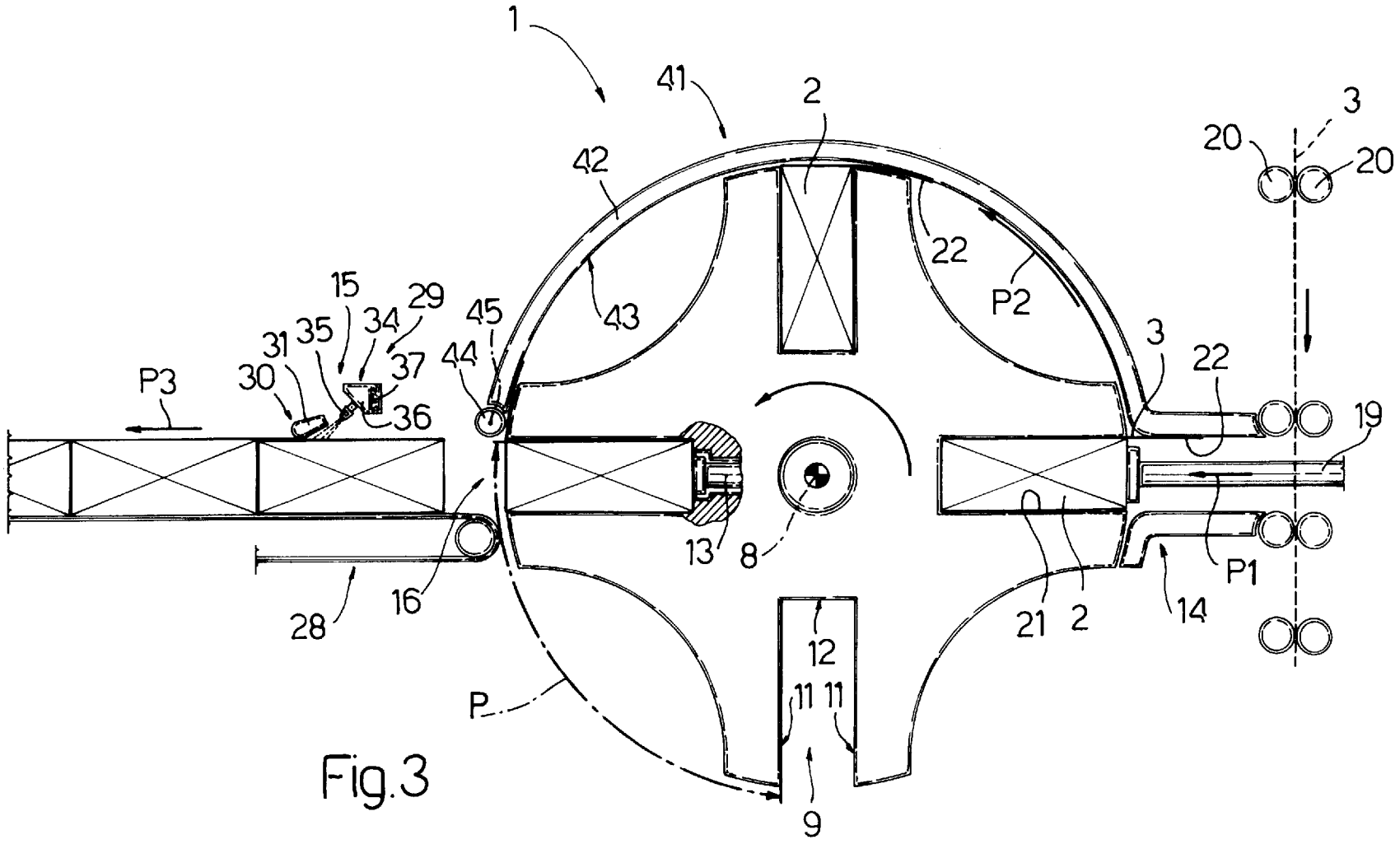
FIG. 3 shows a front view, with parts removed for clarity, of a variation of the FIG. 1 device.

In the FIG. 3 variation, movable folding device 23 is eliminated; gumming station 15 and gumming unit 29, as opposed to being positioned between stations 14 and 16 as described above, are positioned along path P3 and inside unloading station 16; and provision is made, between folding station 14 and unloading station 16, for a fixed folding device 41 comprising a curved plate 42 having a surface 43 facing and mating with surface 10 of wheel 7 with a relatively small amount of radial clearance.

A roller 44, rotating about a respective axis 45 parallel to axis 8, is located at the end of plate 42 at unloading station 16 to fold the last free portion 22 as packet 2 is expelled from pocket 9.

In actual use, feed assembly 20 retains sheet 3 in a position of interference with path P1, so that the portion of sheet 3 over path P1 is greater than the portion of the same sheet 3 beneath path P1, and so that, when the sheet is folded into a U, portion 21 is positioned contacting one of the large lateral surfaces 4, while portion 22 projects from pocket 9 together with a further portion of sheet 3.

As pocket 9 is fed towards unloading station 16, the further portion of sheet 3 projecting from pocket 9 is folded onto the free surface 5 of packet 2, while portion 22 is positioned between the outer surface 10 of wheel 7 and surface 43 of plate 42.

As packet 2 is expelled from pocket 9, portion 22 is folded by roller 44 onto portion 21 and along surface 4 of packet 2; and, once the tubular wrapping is formed, the gumming operation is performed along path P3 as conveyor 28 is arrested and in the same way as described with reference to FIG. 1.

What is claimed is:

1. A folding method for forming a sealed tubular wrapping about a packet (2), the method comprising the steps of feeding the packet (2), together with a sheet (3) of wrapping material, into a pocket (9) of a folding step conveyor (7) so as to fold the wrapping sheet (3) in a U about the packet (2) with two end portions (21, 22) of the wrapping sheet (3) extending outside the pocket (9); folding said sheet (3) into a tube about said packet (2) by superimposing the first end portion (22) on the second end portion (21); detaching the first end portion (22) from the second end portion (21); depositing an adhesive substance between the first (22) and second (21) end portions; and bringing the first end portion (22) back into contact with the second end portion (21).

2. A method as claimed in claim 1, wherein said step of detaching the first end portion (22) from the second (21) is performed by a suction plate (31) movable between a pickup position in which the suction plate (31) is positioned contacting said first end portion (22), and a raised position in which the suction plate (31) holds the first end portion (22) at a given distance from the second end portion (21).

3. A method as claimed in claim 2, wherein said suction plate (31) is moved between said pickup position and said raised position by rotating about an axis (32) parallel to a lateral surface (4; 5) of the packet (2) contacting said end portions (22, 21).

4. A method as claimed in claim 1, wherein the packet (2) is fed in steps along a given path (P2; P3); said adhesive substance being applied by gumming members (34) movable crosswise to said path (P2; P3).

5. A method as claimed in claim 1, wherein said adhesive substance is applied during a stop of the folding conveyor (7).

6. A method as claimed in claim 5, wherein said packet (2) is in the form of a parallelepipedon, and comprises a first pair of large lateral surfaces (4) and a second pair of small lateral surfaces (5); the first end portion (22) being superimposed on the second end portion (21) along one of the small lateral surfaces (5) of the packet (2).

7. A method as claimed in claim 4, wherein said path (P3) is defined by an unloading conveyor (28), which receives each packet (2), together with the sheet (3) of wrapping material folded into a tube about the packet (2), from the folding conveyor (7); said adhesive substance being applied during a stop of the unloading conveyor (28).

8. A method as claimed in claim 7, wherein the packet (2) is in the form of a parallelepipedon, and comprises a first pair of large lateral surfaces (4) and a second pair of small lateral surfaces (5); the first end portion (22) being superimposed on the second end portion (21) along one of the large lateral surfaces (4) of the packet (2).

9. A method as claimed in claim 1, wherein said adhesive substance is deposited between the first and second end portions by depositing said adhesive substance onto an upper surface of said second portion which is now exposed by the detaching of the first end portion form the second end portion.

10. A method as claimed in claim 9, wherein said first end portion is detached from said second end portion by lifting said first end portion away from said second end portion.

* * * * *